US005934557A

United States Patent [19]

Shih

[11] Patent Number: 5,934,557

[45] Date of Patent: Aug. 10, 1999

[54] DECORATIVE FOUNTAIN

[76] Inventor: Barry Shih, 2F, No. 321, PaTeh Rd., Sec. 4, Taipei, Taiwan

[21] Appl. No.: 09/036,571

[22] Filed: Mar. 6, 1998

[51] Int. Cl.[6] ..... B05B 17/08; B05B 1/36

[52] U.S. Cl. ..... 239/17; 239/193

[58] Field of Search ..... 239/17, 20, 21, 239/193, 199

[56] References Cited

U.S. PATENT DOCUMENTS

| | | | |
|---|---|---|---|
| 3,211,378 | 10/1965 | Zysk | 239/20 |
| 4,149,674 | 4/1979 | Fukamizu et al. | 239/20 |
| 4,881,280 | 11/1989 | Lesikar | 239/20 X |
| 5,217,161 | 6/1993 | Souza | 239/20 |
| 5,226,935 | 7/1993 | Wolff et al. | 239/193 X |

*Primary Examiner*—Kevin Weldon

*Attorney, Agent, or Firm*—W. Wayne Liauh

[57] ABSTRACT

A decorative fountain includes a body, a motor pump housed in a water box, a water deflector and an IC battery chamber housed at the bottom of the body. The body includes a base which has a lower water trough which holds the water box and a top cover including an upper trough which attaches the water deflector at an opening thereof. The water box has a water inlet fluidly communicates with the lower water trough. The motor pump has a water outlet leading to the upper trough. Activating the motor pump, water will be pumped from the lower water trough to the upper trough and then drops to the lower water trough for continuous circulation. The IC battery chamber is located below the water troughs and thus is free from water moisture erosion. The base and the top cover may be integrally formed. The body therefore may be made water tight without additional painting work. It is simple to produce and assemble, and also more reliable and trouble free.

6 Claims, 6 Drawing Sheets

DECORATIVE FOUNTAIN

BACKGROUND OF THE INVENTION

1. Field of the Invention

This invention relates to decorative fountain and particularly to a decorative fountain with a motor pump housed in a water box which is located in a fountain body so that the leakage may be prevented, installation is simple and appealing durability may be enhanced.

2. Description of the Prior Art

A small size table top decorative fountain has increasingly appeared in households and offices to help people relaxing in the busy and high stress daily work. FIG. 1 shows a conventional decorative fountain which includes a fountain body A, an upper water trough B, a lower water trough C, a motor pump D for pumping water from the trough C to the trough B through a pipe E and a battery box F which has an IC board located therein for controlling the motor pump operation and to trigger a musical means. When water is filled in the upper trough B and overflowed, it drops to the lower trough C and to be circulated to the upper trough B again by means of the motor pump D. It thus achieves amusement effect.

There are a number of disadvantages in the conventional decorative fountain set forth above. The interior of the troughs B and C usually are sprayed with paint to avoid water leaking. The paint could degrade after long time of use. It could result in deposits, and making water murky, blocking the piping and even making the pump motor breakdown.

The motor pump D has to be installed from the rear side of the body A. It is cumbersome and making the rear side of the fountain not good looking. The IC board and the battery box F are located above the water trough C. Water moisture tends to seep and gather on the IC board and could result in IC circuits erosion and malfunction. The pipe E usually has a 90-degree elbow which is prone to trap deposits and block water flow. A new battery tends to make the motor pump D pumping water with stronger power and results in water spilling out of the water troughs B and C when flowing out of the pipe E exit. All of these problems beg for improvements.

SUMMARY OF THE INVENTION

In view of aforesaid disadvantages, it is therefore an object of this invention to provide a decorative fountain which has a two-piece body, a water case to house a motor pump and a battery chamber located below the water trough for avoiding moisture induced malfunction. The device is simple to produce and build, and may function more reliably without leaking or breaking down.

It is another object of this invention to provide a decorative fountain which has a two-piece body and a motor pump located in the body. It is simple to produce at low cost, and looks more appealing.

It is a further object of this invention to provide a decorative fountain which has an IC battery chamber located at a bottom portion of the body. It is therefore less prone to disorder and may look more appealing.

It is yet another object of this invention to provide a decorative fountain which has a vertical discharge pipe from the water motor pump to avoid deposits formation. There is also provided with a water deflectors around the water exit to prevent water spilling outside of the fountain.

It is still another object of this invention to provide a decorative fountain in which the motor pump is audio-activated for increasing amusement effect.

It is a further object of this invention to provide a decorative fountain in which a water case is used as an upper water trough for better water tight effect.

The decorative fountain according to this invention includes a body, a motor pump, a water box, a water deflector and an IC battery chamber. The body includes a base and a top cover. The motor pump is housed in a water tight water case located in the base and pumps water from a lower trough to an upper trough located in the top cover. Water drops from the upper trough to the lower trough for continuous circulation. A water deflector is deposed in the top cover to prevent water from spilling out of the fountain. The IC battery chamber is located under the lower trough to avoid moisture indeed malfunction. The structure is simple and easy to assemble. It may be made water tight without leaking. It is also looks more appealing.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
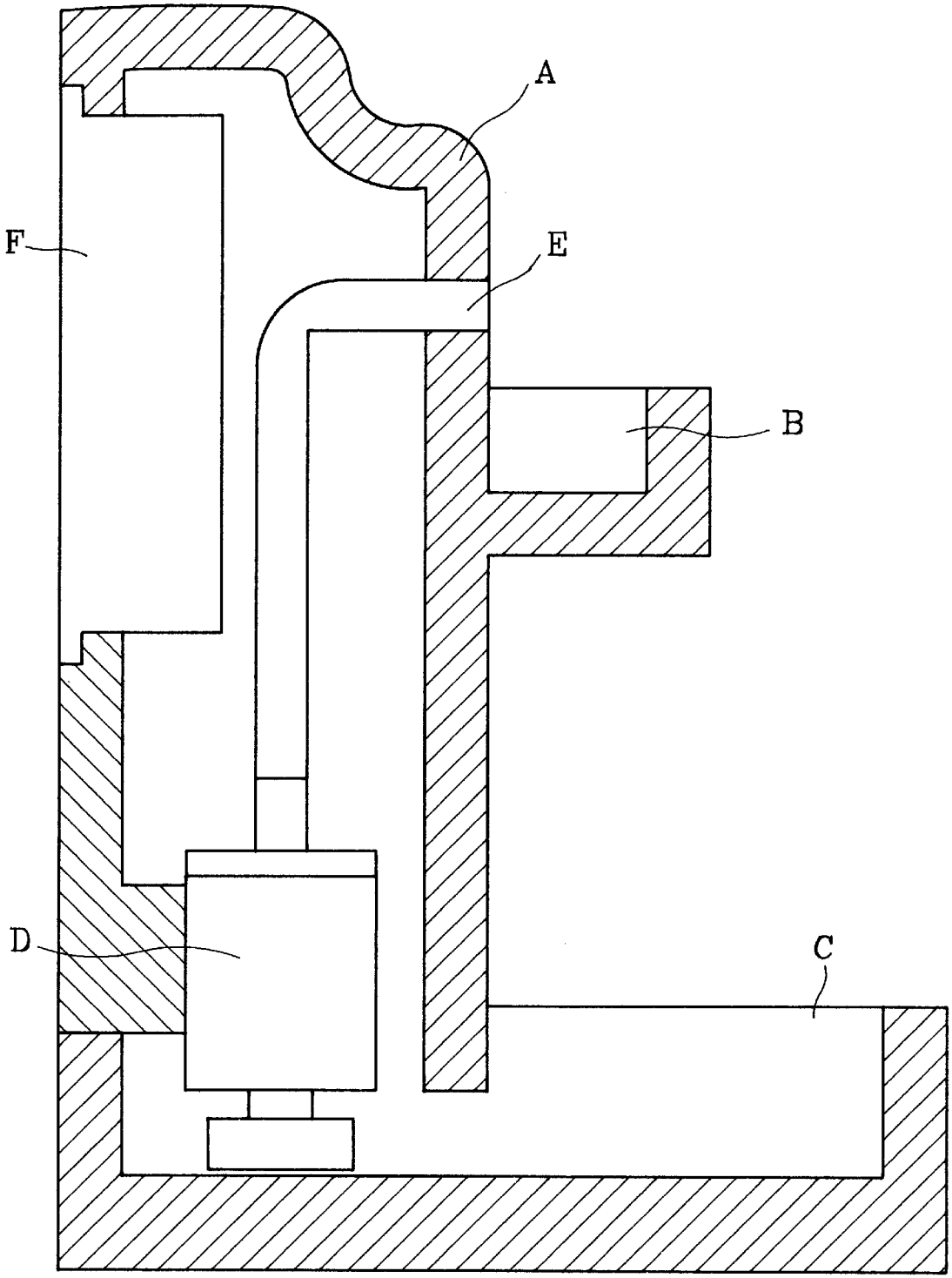
FIG. 1 (PRIOR ART)
FIG. 1 is a sectional view of a conventional decorative fountain.
Figure 2:
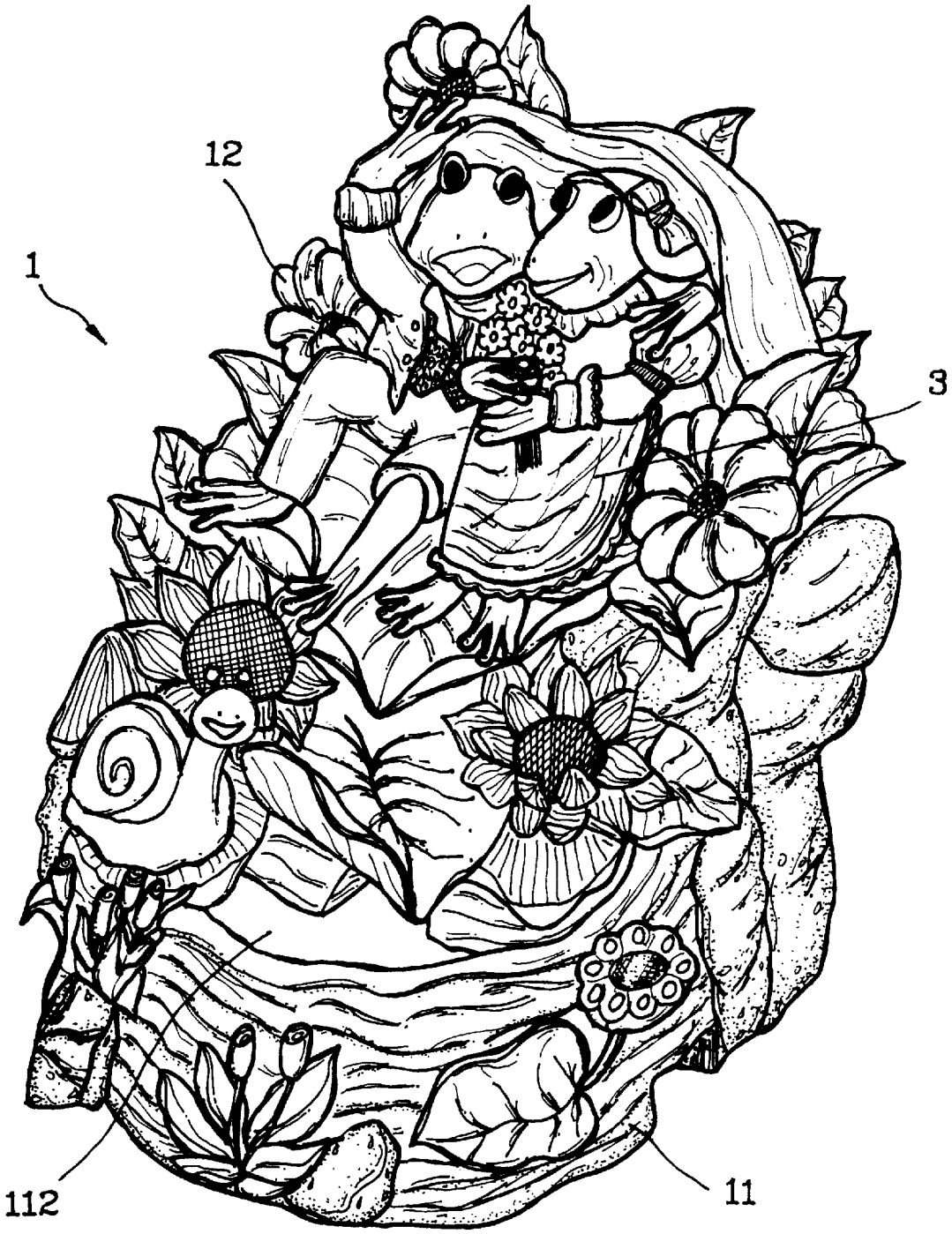
FIG. 2 is a pictorial view of this invention.
Figure 3:
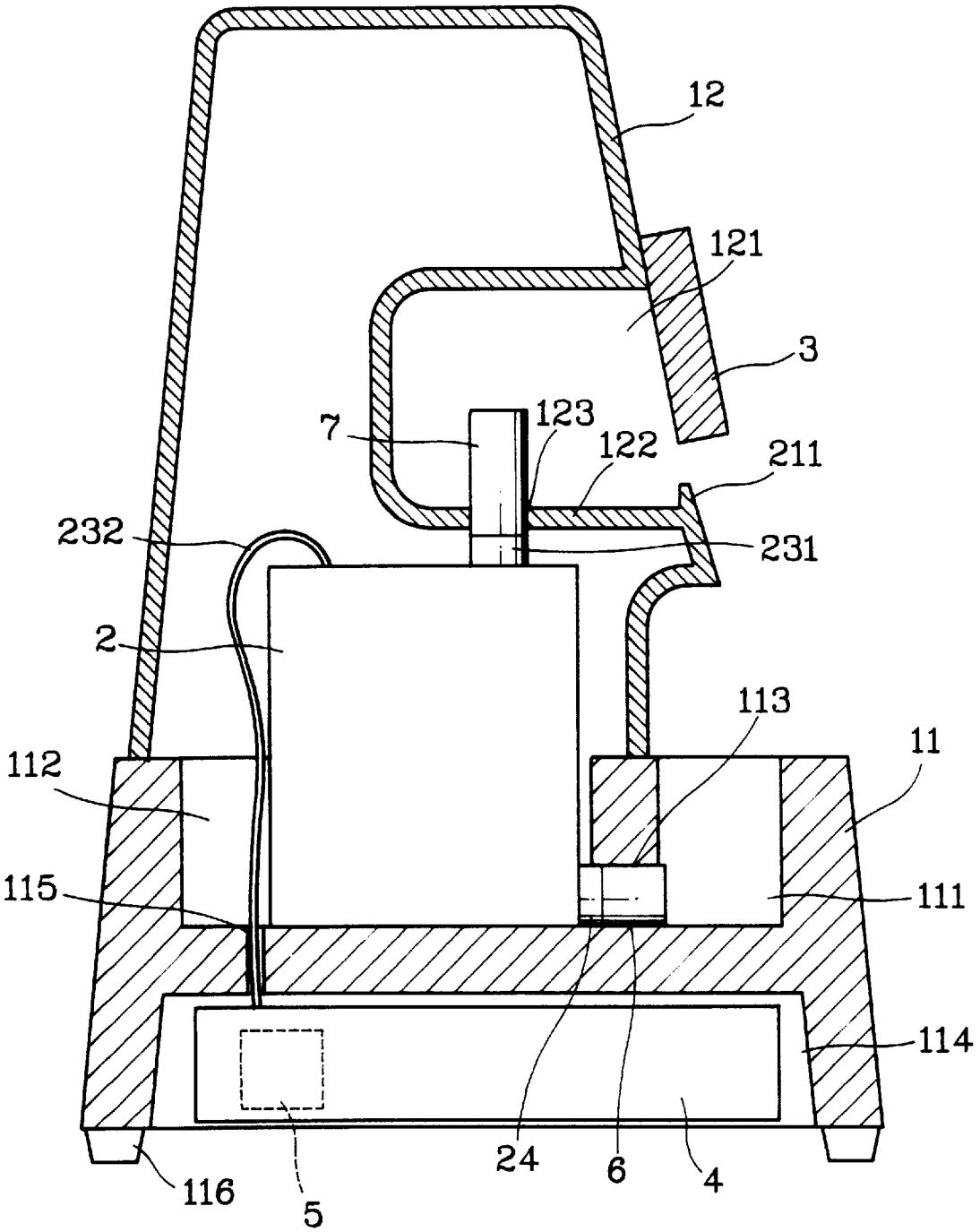
FIG. 3 is a sectional view of this invention.
Figure 4:
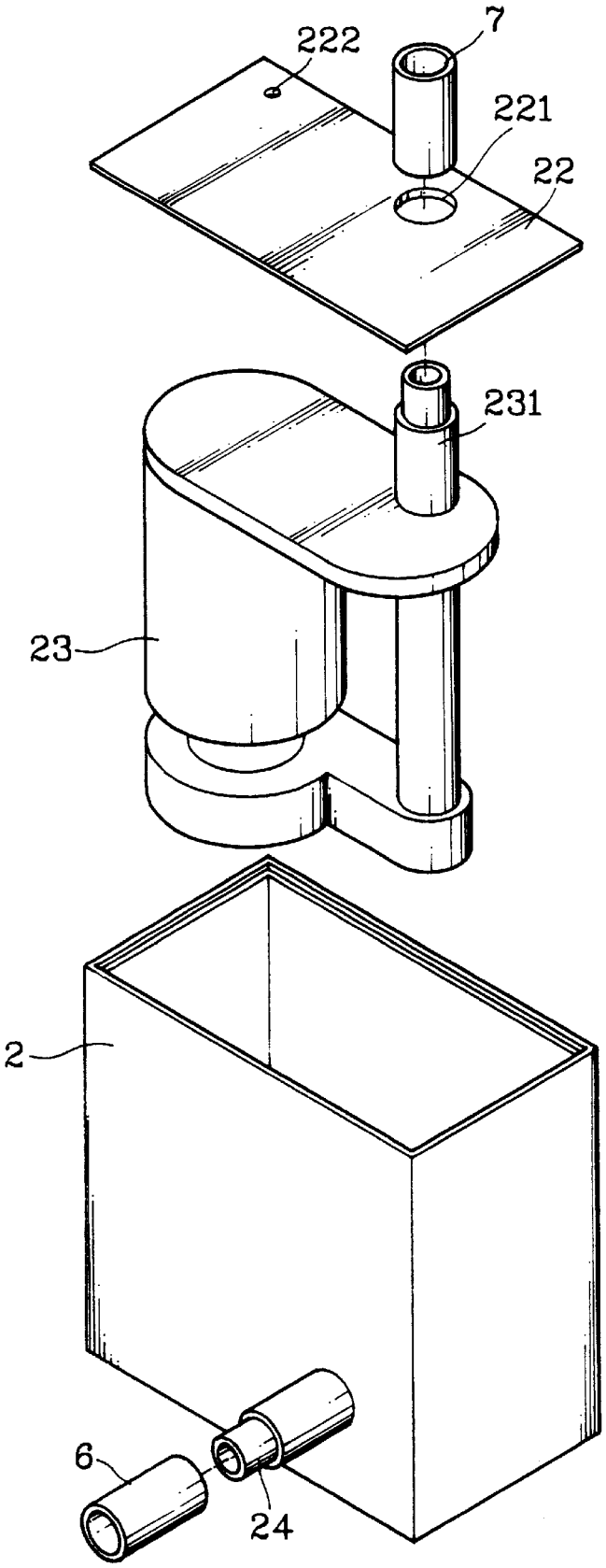
FIG. 4 is an exploded view of a motor pump and a water box of this invention.
Figure 5:
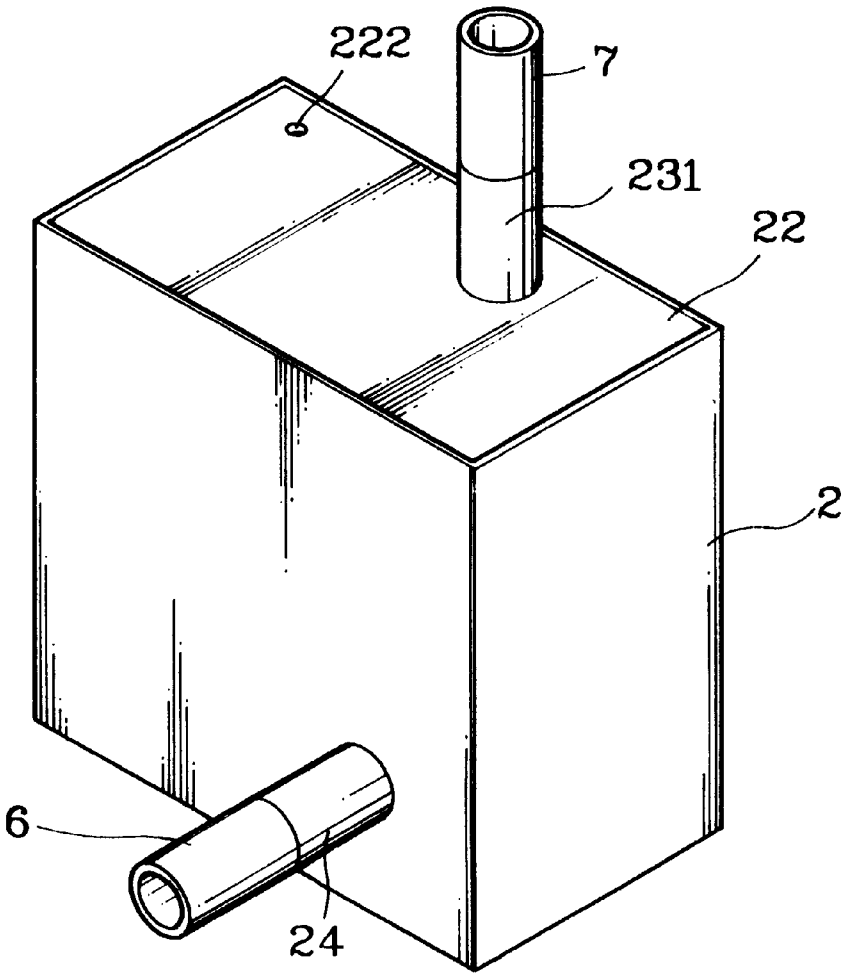
FIG. 5 is a perspective view of a water box.

Referring to FIGS. 2, 3 and 4, the decorative fountain according to this invention includes a body 1, a motor pump 23, a water box 2, a water deflector 3 and an IC battery chamber 4. The body 1 includes a base 11 and a top cover 12 both of which are integrally formed respectively and therefore are water tight. The base 11 has a cavity 111 and a lower water trough 112 on an upper portion, and a chamber room 114 at the bottom for housing the IC battery chamber 4. Between the cavity 111 and the lower water trough 112, there is a first through bore 113. There is a second through bore 115 between the chamber room 114 and the lower water trough 112.

The top cover 12 has an upper trough 121 with a bottom floor 122 which has a third through bore 123. The motor pump 23 is housed in the water box 2 which is located in the cavity 111. At a lateral side of the bottom, the water box 2 has a water inlet 24 which connects with a first pipe 6 which then passes through the first bore 113 to the cavity 111. The water box 2 has a top step groove 21 on a top rim to form a water tight engagement with a lid 22. The lid 22 has an aperture 222 and a fourth bore 221. The motor pump 23 has a water outlet 231 running through the third bore 123 and the fourth bore 221 via a second pipe 7. The motor pump 23 further has an electrical wire 232 running through the aperture 222 and the second bore 115 to the IC battery chamber 4 which provides power to operate the motor pump. All bores 113, 115, 123 and aperture 222 are sealed to water tight after being engaged respectively with the pipes 6, 7 and wire 232. The floor of the upper trough 121 has an upward flange 124 to form a disk to hold water to a desired level. At the opening of the upper trough 121, the water deflector 3 is located thereon to prevent water exited from the pipe 7 from spilling outside the base 11.

When in use the lower water trough 112 is filled with water, the IC battery chamber 4 provides power to activate the motor pump 23. Water is pumped from the inlet 24 to the outlet 231 and flows into the disk of the upper trough 121 until it is overflowing. The overflowing water then drops down to the lower water trough 112 for circulation again. Since the base 11 and top cover 12 are integrally formed respectively, they are water tight without painting. There is therefore no paint degradation problem which might otherwise making water murky or blocking the water passage in the motor pump piping system. As the IC battery chamber 4 is located below the lower water trough, it thus is free from water moisture and the ensued IC board erosion or breakdown. Both the water box and IC battery chamber are housed within the body separately, they are simpler to install and without impair outside look of the fountain.

The IC battery chamber 4 may further be activated by an audio switch 5 to increase the amusement effect. The bottom of base 11 may further be padded with rubber pedestals 116 to make the fountain sitting more steadily and to absorb vibration that might occur when the motor pump operates.

Figure 6:
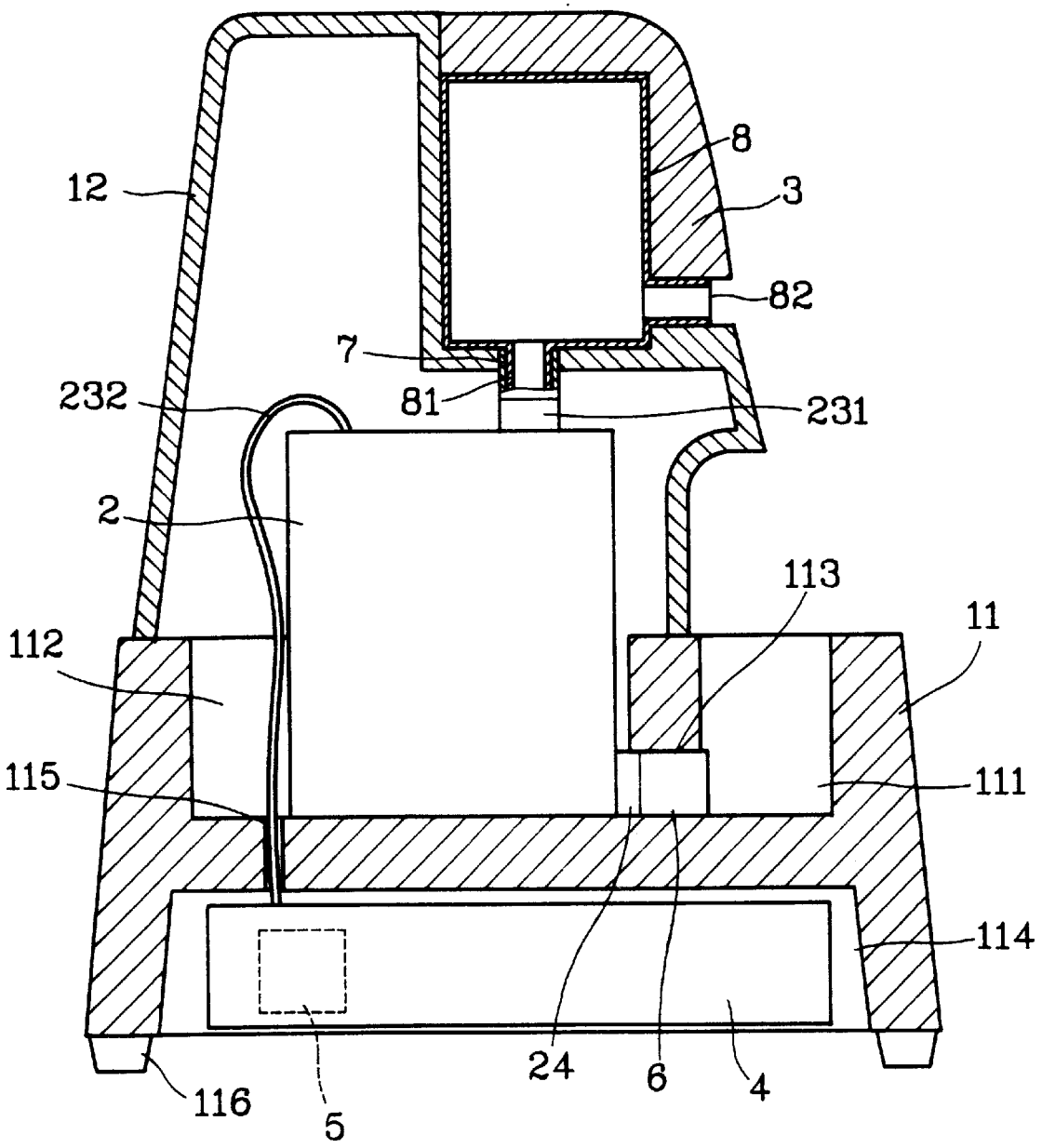
FIG. 6 is a sectional view of another embodiment of this invention.

FIG. 6 illustrates another embodiment of this invention. It uses a closed second water box 8 located in the upper trough 121. The second water box 8 has a second water inlet 81 connecting with the pipe 7 of the motor pump 23, and a second water outlet 82 for discharging water into the lower water trough 112. This embodiment has even better water tight effect than the one set forth above.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

What is claimed is:

1. A decorative fountain comprising:

a body including a top cover and a base, the base having a cavity, a lower water trough, a chamber room below the cavity, a first through bore between the cavity and the lower water trough, and a second through bore between the cavity and the chamber room; the top cover having an upper trough with a third through bore in a bottom wall thereof;

a water box located in the cavity having a lid, a water inlet connecting with a first pipe on a lateral side thereof, the first pipe being fluidly communicating with the lower water trough, and a fourth through bore in the lid, the lid having an aperture formed therein;

a motor pump housed in the water box having a water outlet connecting with a second pipe running through the third bore, the second pipe being fluidly communicating with the upper trough, the water outlet running through the fourth bore; a water deflector attached to the upper trough at an opening thereof; and an IC battery chamber located in the chamber room wiring to the motor pump via the aperture and the second through bore.

2. A decorative fountain of claim 1, wherein the water box has a step groove on a top rim engageable with the lid.

3. A decorative fountain of claim 1, wherein the floor of the upper trough has an upward flange at an outside edge.

4. A decorative fountain of claim 1 further having an audio switch for activating the motor pump.

5. A decorative fountain of claim 1 further having rubber pedestals under the bottom of the base.

6. A decorative fountain of claim 1, wherein the upper trough has a second water box located therein, the second water box has a second water inlet fluidly communicating with the second pipe of the motor pump and a second water outlet.

* * * * *